United States Patent [19]

Endo et al.

[11] Patent Number: 4,593,963

[45] Date of Patent: Jun. 10, 1986

[54] WIRE-HARNESS FOR AUTOMOBILES

[75] Inventors: Takayoshi Endo, Shizuoka; Toshimasa Sugiyama, Numazu; Satoru Murofushi, Shizuoka; Sakai Yagi, Gotenba, all of Japan

[73] Assignee: Yazaki Corporation, Tokyo, Japan

[21] Appl. No.: 663,419

[22] Filed: Oct. 22, 1984

[30] Foreign Application Priority Data

Oct. 26, 1983 [JP] Japan ..... 58-199163

[51] Int. Cl.[4] ..... H01R 4/24

[52] U.S. Cl. ..... 339/97 R; 339/258 R

[58] Field of Search ..... 339/97 R, 97 P, 98, 339/99 R, 176 MP, 258 R

[56] References Cited

U.S. PATENT DOCUMENTS

| | | | |
|---|---|---|---|
| 3,233,211 | 2/1966 | Smith | 339/258 R |
| 3,348,191 | 10/1967 | Kinkaid | 339/176 MP |
| 4,002,391 | 1/1977 | Dunn et al. | 339/98 |
| 4,029,384 | 6/1977 | Reinwall, Jr. | 339/98 |
| 4,230,391 | 10/1980 | Keglewitsch | 339/97 R |
| 4,266,843 | 5/1981 | Marsh et al. | 339/97 R |
| 4,291,935 | 9/1981 | Badoz et al. | 339/97 R |
| 4,385,794 | 5/1983 | Lucius | 339/97 R |
| 4,472,596 | 9/1984 | Brown et al. | 339/97 R |
| 4,491,379 | 1/1985 | Brown et al. | 339/97 P |

*Primary Examiner*—Joseph H. McGlynn

*Attorney, Agent, or Firm*—Schwartz, Jeffery, Schwaab, Mack, Blumenthal & Evans

[57] ABSTRACT

A compact wire-harness is produced through automatic assembly by utilizing a compact, twisted and compressed wire for the insulated wire to be connected to the wire-harness of the slotted terminal type. The wire-harness comprises a terminal contact portion of thin sheet-like material rich in spring capacity and a wire connecting portion of thick plate-like material to increase the strength or electric current capacity of the portion.

12 Claims, 14 Drawing Figures

WIRE-HARNESS FOR AUTOMOBILES

FIELD OF THE INVENTION

The present invention relates to a wire-harness for automobiles, and more specifically a wire-harness for automobiles to receive compact insulated or coated wire portions and a terminal capable of being connected to each of the wire portions through a simple connecting operation whereby a stable connection suitable for simple automatic wire-harness assembling is provided.

BACKGROUND OF THE INVENTION

There is a general tendency for wire-harnesses to become large in size in correspondence with electronic devices increasingly used in recent automobiles. In order to keep such a wire-harness compact, multiple wiring systems for the wire-harness have been developed, and particularly it has been proposed that the insulated or coated wire for the wire-harness must be compact in size.

On the other hand, the automatic assembling of the wire-harness having jumbled wires due to a complex circuit arrangement has been developed, for example, a system in which a wire is terminated in a slotted terminal without the use of crimping which is a typical conventional way to connect the wire to the terminal.

In a conventional structure to connect a wire to the slotted terminal, the slotted terminal comprises a terminal contact portion integrally formed with a wire connecting portion having a slotted opening having a width less than the diameter of the wire. In addition, a tinned, twisted concentric wire or an integrally tinned wire is used for the coated wire in the conventional structure.

The term "twisted concentric wire" is used herein to mean a plurality of individual strands about a central core strand in a concentric array which are helically stranded or twisted.

The term "integrally tinned wire" is used herein to mean a plurality of individual strands integrally bundled through tinning.

When the twisted concentric wire is connected to the slotted terminal, the wire is inclined to be deformed, resulting in variance in connecting operation, so that it is not easy to produce completely reliable connection with this wire.

When the integrally tinned wire is connected to the slotted terminal, the integrity in shape of the wire inserted in the wire connecting portion is kept, thereby providing excellent electric connection. However, since the wire of this type is insufficient in flexibility, it is not easy to incorporate such a wire-harness having the wire of this type into a vehicle and in addition, the wire sometimes breaks due to vibrations in use.

SUMMARY OF THE INVENTION

Accordingly, the major object of the present invention is to provide a compact wire-harness of the slotted terminal type which does not decrease the electric current capacity.

Another object of the present invention is to provide a wire-harness of the slotted terminal type in which the integrity of the wire is kept through the operation of connecting the wire to the slotted terminal.

Another object of the present invention is to provide a wire-harness of the slotted terminal type having enough flexibility as well as enough strength.

Another object of the present invention is to provide a wire-harness of the slotted terminal type suitable for automatic assembly.

Another object of the present invention is to provide a wire-harness of the slotted terminal type comprising a wire connecting portion and a terminal contact portion the structures of which are harmonized so as for each portion to properly function.

In order to accomplish these objects in the present invention, a twisted and compressed wire is incorporated into the wire-harness for the insulated or coated wire in place of the conventional helically stranded wire such as the twisted concentric wire.

The term "twisted and compressed wire" is used herein to mean a wire produced by compressing the twisted concentric wire as defined previously to substantially deform or flatten only the outermost surface thereof.

The twisted and compressed wire is a kind of insulated or coated wires which have been used for interior or outerior wiring or transmission line. The wire is produced by compressing the twisted concentric wire as mentioned above to eliminate any gaps from between the strands, thereby reducing the wire diameter, conserving the coating material for the wire and serving to prevent stress corrosion in the wire. The twisted and compressed wire has increased strength with a smaller diameter than the conventional twisted concentric wire for the insulated or coated wire.

The twisted and compressed wire is often referred to as S.B. conductor in the Japanese electric wire industry.

The inventors have founded that a compact wire-harness can be produced through automatic assembly by utilizing the compact, twisted and compressed wire or S.B. conductor for the insulated wire in the wire-harness without decreasing the electric current capacity, the wire-harness having increased strength without compromise in flexibility, wherein excellent connection is provided between the wire and the slotted terminal.

In addition, upon the use of the twisted and compressed wire in the wire-harness, the terminal contact portion and the wire connecting portion of the slotted terminal in the wire-harness are constructed to harmonize with their functions in the present invention.

Further, according to the present invention, the terminal contact portion and the wire connecting portion of the slotted terminal can be produced separately before joining so as to utilize suitable materials for the terminal contact portion and the wire connecting portion, respectively.

These and other aspects and advantages of the invention will become apparent by reference to the following detailed description of preferred embodiments when considered in conjunction with the accompanying drawings, wherein like numerals correspond to like elements throughout the drawings.

BRIEF DESCRIPTION OF THE DRAWINGS

FIG. 1(*b*) is a cross sectional view taken along the line I—I of FIG. 1(*a*).

FIG. 4(*b*) is a cross sectional view of a conventional twisted and compressed wire.

FIG. 8(*b*) is a perspective view of a twisted and compressed wire to be connected to the slotted terminal of FIG. 8(*a*).

DETAILED DESCRIPTION OF PREFERRED EMBODIMENTS

Figure 1:
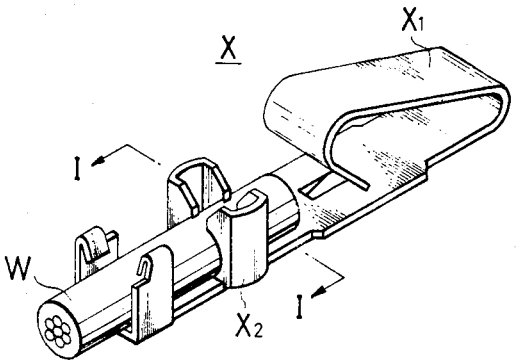
FIG. 1 (a) PRIOR ART
FIG. 1(*a*) is a perspective view of the conventional connection between, a wire and a slotted terminal.
Figure 1B:
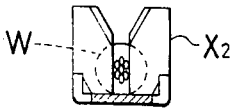
FIG. 1(b) PRIOR ART
Figure 2:
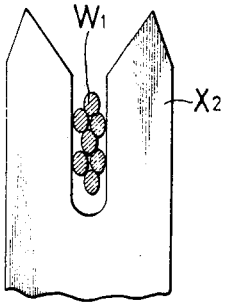
FIG. 2 PRIOR ART
FIG. 2 is an enlarged view showing the connection between a twisted concentric wire and a slotted terminal after assembly.
Figure 3:
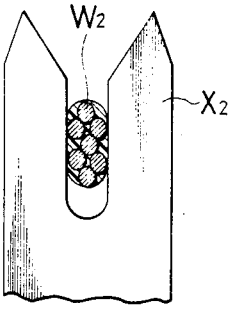
FIG. 3 PRIOR ART
FIG. 3 is an enlarged view showing the connection between an integrally tinned wire and a slotted terminal fitting after assembly.

Referring now to FIGS. 1 to 3, a structure of the conventional slotted terminal connected to a wire is illustrated, the slotted terminal designated by character X comprises a terminal contact portion $X_1$ and a wire connecting portion $X_2$ having a U-shaped wire connecting section for receiving an insulated wire W, wherein a tinned twisted concentric wire $W_1$ or an integrally tinned wire $W_2$ is used for the insulated wire W.

As mentioned previously, the twisted concentric wire $W_1$ has a shortcoming that it is easily deformed during assembling operation, whereas the integrally tinned wire $W_2$, although its integrity is kept well during assembling operation, has insufficient flexibility.

Referring to FIGS. 4 to 10, the wire-harness for automobiles according to the present invention comprises a plurality of insulated or coated wires each comprising a plurality of strands and a slotted terminal connected to each of the insulated or coated wires.

The insulated wire comprises a twisted and compressed wire as mentioned previously, which is referred to as S.B. conductor hereinafter.

The S.B. conductor is produced by compressing a helically stranded wire W to eliminate any gaps from between the strands 1 therein.

The desirable compressibility is 7 to 15 percent to keep sufficient flexibility.

Table I shows the comparison in outer diameter between S.B. conductors used in the present invention and wires used for the conventional wire harnesses.

TABLE I

| Nominal Number | Wires for Conventional Wire-Harness, mm. | S.B. Conductor for the Present Invention, mm. |
|---|---|---|
| 0.5 | about 1.0 | 0.8–0.9 |
| 0.85 | about 1.2 | 1–1.1 |
| 1.25 | about 1.5 | 1.2 |

Figure 5:
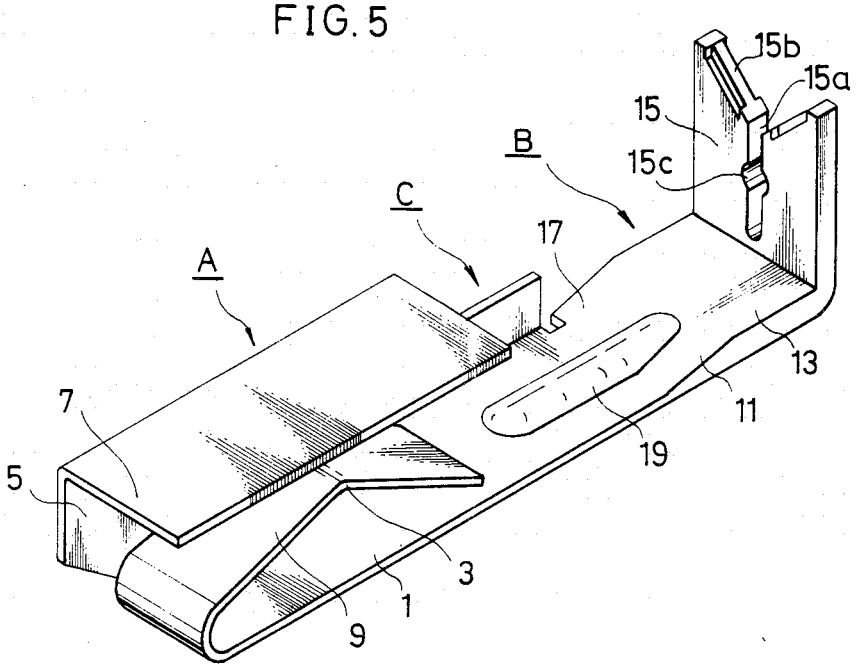
FIG. 5 is a perspective view of one embodiment of the slotted terminal according to the present invention.

FIG. 5 illustrates a first embodiment of the slotted terminal according to the present invention, which comprises a terminal contact portion A and a wire connecting portion B with a slotted opening. A and B are made from a single piece of material to form the slotted terminal designated by character C. The terminal contact portion A, the forward half of the slotted terminal fitting C, comprises a base 1 having a bent back portion inclined over the base 1 the bent back portion being further bent at a further distal location toward the base 1, thereby forming a resilient contact tang 3, a side extension folded upwards to form a side wall 5, the upper portion of which is bent in parallel to the base 1 to form a top wall 7 overlying the resilient contact tang 3, wherein the clearance 9 between the top wall 7 and the resilient contact tang 3 is adapted to receive a terminal to be mated therewith.

The wire connecting portion B, the rear half of the slotted terminal C, is generally larger in thickness than the terminal contact portion A. This is because the wire connecting portion B must have enough strength to bear the S.B. conductor forced into the slotted opening thereof, whereas the terminal contact portion A requires resilience rather than strength. The thickness of the wire connecting portion B is desirably 1.2 to 8 times that of the terminal contact portion A.

The wire connecting portion B is constructed in a manner that the base 1 is integrally formed through a sloped transition section 11 with a thicker section 13, the distal end of which is bent to form an upright wire connecting section 15. Provided at the central portion of the wire connecting section 15 is a slotted opening 15*a* above which tapered edges 15*b* are provided for guiding the wire. The slotted opening 15*a* is provided with opposing arcuate recesses 15*c* to receive the wire therein under pressure.

In order to increase strength at the boundary area 17 between the base 1 and the thicker section 13, specifically the sloped transition section 11, a reinforcing member 19 such as beading is provided, thereby preventing the terminal from bending.

The slotted terminal C as mentioned above is produced by pressing a sheet-like or ribbon-like piece of deformed material having a varying dimension, such that the dimensional ratio in thickness of the terminal contact portion A to the wire connecting portion B is in the range of 1:1.2 to 1:8.

The slotted terminal C may be produced by separately forming the terminal contact portion A and the wire connecting portion B with dissimilar materials and then connecting both portions to each other, wherein materials can be selected for both portions to have suitable mechanical and electrical properties, respectively. Such embodiments of the present invention will be described hereinafter.

Figure 4A:
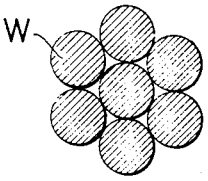
FIG. 4(*a*) is a cross sectional view of a conventional helically stranded wire.
Figure 4B:
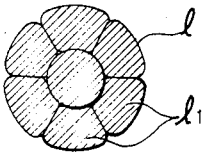
Figure 6:
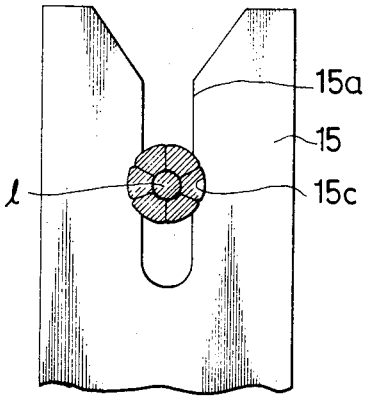
FIG. 6 is an enlarged view illustrating the connection between a twisted and compressed wire and the slotted terminal according to the present invention.

It is in a manner as disclosed in the prior art that a wire L, specifically, S. B. Conductor as illustrated in FIG. 4(*b*) is forcedly mounted to the slotted terminal of the present invention. It will be noted that after assembling, the outer periphery of the S. B. conductor L generally tightly engages with the arcuate recesses 15*c* of the slotted opening 15*a* as shown in FIG. 6.

Figure 7A:
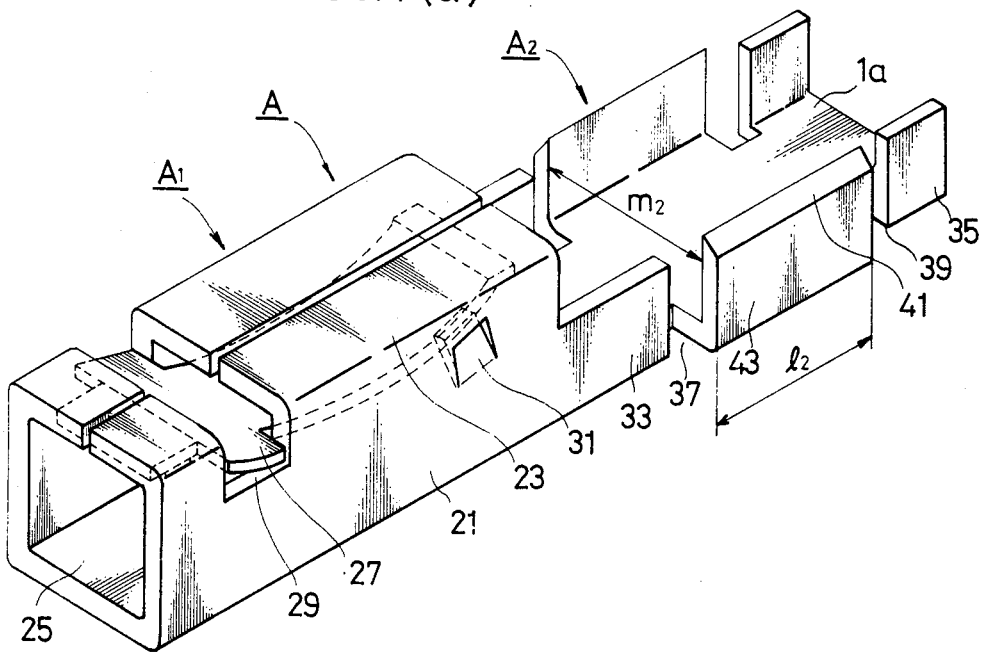
FIGS. 7(*a*) and 7(*b*) are exploded perspective views of a second embodiment of the slotted terminal according to the present imention.
Figure 7B:
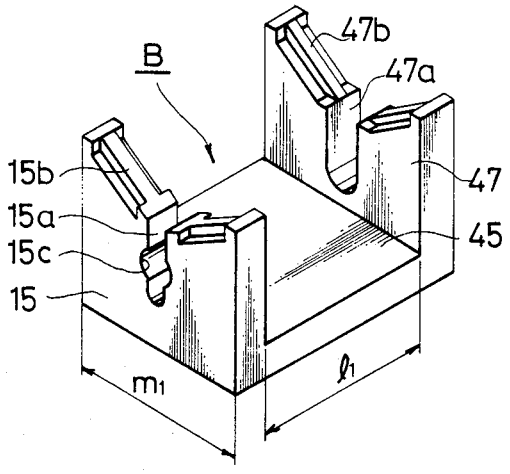

Referring to FIG. 7 illustrating a second embodiment of the present invention, the slotted terminal comprises a terminal contact portion A made from a sheet as in FIG. 7(*a*) and a wire contacting portion B made from a thicker plate as in FIG. 7(*b*), which are independently formed.

The terminal contact portion or unit A comprises a terminal contact section $A_1$ and a fixing section or wire connecting portion mount $A_2$. The terminal contact section $A_1$ first side walls 21, a top wall 23 so as to define a hole 25 to receive a mating terminal. Secured within the hole 25 is a leaf spring means 27 made from another material. Formed at the front portion of the top wall 23 is a cutout 29 for supporting one end of the leaf spring means, whereas formed at the rear upper portion of the side walls are projected tabs 31 for supporting the other end of the leaf spring means. Further, the rearmost end of each first side wall 21 is stepwisely reduced in height to form a side wall extension 33.

The wire connecting portion mount $A_2$ is integrally formed with the terminal contact section $A_1$ on the rear side thereof, and has first upright side walls 35 at the rearmost thereof and second upright side walls 43 between the side wall extensions 33 and the third side walls 35 with gaps 37 between the side wall extensions and the second side walls 43 and with gaps 39 between the second side walls 43 and the third side walls 35.

The third side wall 35 is formed by folding the side extension of the rearmost end portion 1*a* upwards, and the second side wall 43 has a knife-edged top end 41 for securing the wire connecting portion B, which will be described hereinafter.

In place of the side wall extension 33 continuous to the first side wall 21 of the terminal contact portion A, a separate side wall can be provided.

It will be noted that the terminal contact portion A can be easily produced by pressing a sheet of electrically conductive material in a manner as in producing the conventional slotted terminal.

The wire connecting portion or unit B comprises a joint section 45 as well as first and second wire connecting sections 15 and 47 which are upright at the opposite ends of the joint section 45. The first wire connecting section 15 is formed with a slotted opening 15*a* at the central portion thereof which is continued to upper tapered edges 15*b* for guiding a wire to be connected. The slotted opening 15*a* is sized in width such that the insulating coating of the wire is broken by the inner edges of the terminal along the slotted opening to tightly engage the conducting material therein with the inner edges of the terminal fitting in a metal-to-metal contact relationship.

The second wire connecting section 47 is also formed with a slotted opening 47*a* at the central portion thereof, and tapered edges 47*b* for wire-guiding above the slotted opening 47*a*. The slotted opening 47*a* is sized in width such that the insulated wire is tightly connected to the inner edges on the slotted opening 47*a* of the second wire connecting section 47.

The length $l_1$ of the joint section 45 between the first and second wire connecting sections 15 and 47 is slightly larger than the width $l_2$ of the wire connecting portion mount $A_2$, whereas the width $m_1$ of the first and second wire connecting sections 15 and 47 is slightly shorter than the length $m_2$ of the bottom wall of the wire connecting portion mount $A_2$.

The ratio in thickness of the sheet material for producing the terminal contact portion A to the thicker plate material for producing the wire connecting portion B is desirably in the range of from 1:1.2 to 1:8.

Figure 8A:
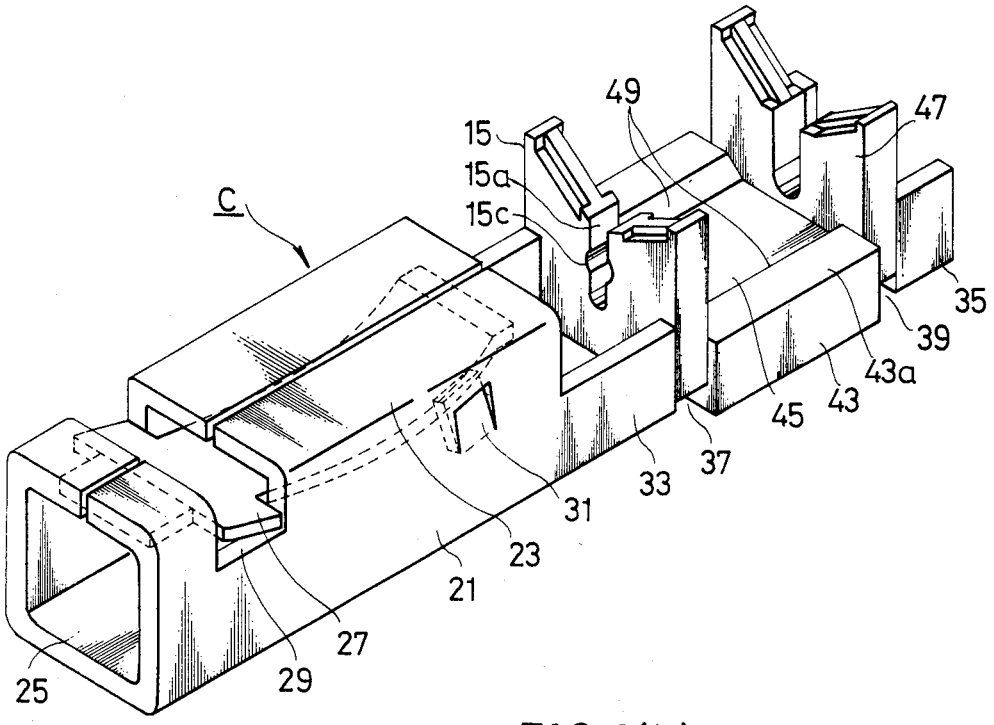
FIG. 8(*a*) is a perspective view of the slotted terminal after assembly of FIG. 7.
Figure 8B:
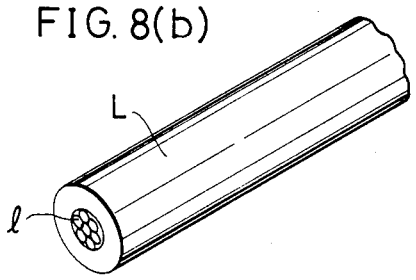

FIG. 8(*a*) illustrates an assembled slotted terminal fitting by mounting the wire connecting portion B to the terminal contact portion A in place, which is in a condition just before receiving the S. B. conductor as shown in FIG. 8(*b*). Specifically, the wire connecting portion B is placed onto the base 1 with the side edges of the joint section 45 abutted to the inner surfaces of the side walls 43 of the wire connecting portion mount $A_2$, and then the upper portion 43*a* of the side wall 43 is bent over the joint section 45 to secure the joint section 45 between the base 1 and the upper portion 43*a*. In order to secure the joint section 45, the knife-edged top ends 41 of the side walls 43 may be crimped together with the joint section 45 by a crimping means (not shown). Any other securing means may be used such as mechanical securing means including riveting, welding means including spot welding and laser welding in lieu of crimping.

It will be noted that the first and second wire connecting sections 15 and 47 are fitted into the gaps 37 and 39 of the wire connecting portion mount $A_2$, respectively.

The terminal contact portion A and the wire connecting portion B of this embodiment can be separately made from different materials 34 having different mechanical and electric properties.

When similar conductive metallic materials are used for the slotted terminal, the terminal contact portion A is made thinner in thickness from a material such a brass as designated by C26000 in an upper box of Table II, which is so rich in spring capacity to be in a good engagement with a mating material, whereas the wire connecting portion B is made thicker from a material such as a brass as designated by C 26000 in a lower box of Table II, which is rich in strength and hardness. It should be noted that the wire connecting portion B of higher strength and hardness material is thicker to increase its electric current capacity because it is generally lower in electric conductivity.

TABLE II

| U.S. ASTEM Standard | Tensile Strength ($Kg/mm^2$) | Hardness ($H_v$) |
|---|---|---|
| C26000 (Half-Hard) | 40–47 | 106–136 |
| C26000 (Extra-Spring) | 67–73 | 192–204 |

When dissimilar metallic materials are used for the slotted terminal, the terminal contact portion A is made thinner in thickness from a metallic material such as beryllium bronze, phosphor bronze as in Tables III and IV, which is rich in spring capacity, although relatively lower in electric conductivity, whereas the wire connecting portion B is made thicker from a metallic material such as copper alloys as in Tables III and IV, which is rich in electric conductivity, although relatively lower in mechanical strength. It should be noted is the wire connecting portion B of higher electric conductivity be thicker to increase its strength because it is generally lower in strength and hardness.

TABLE III

| U.S. ASTEM Standard | Composition | | Tensile Strength ($Kg/mm^2$) | Conductivity |
|---|---|---|---|---|
| C17200 | Be | 1.8–2.0% | 130–151 | 22% |
| | Co + Ni | up to 0.2% | | |
| | Co + Ni + Fe | up to 0.6% | | |

TABLE III-continued

| U.S. ASTEM Standard | Composition | | Tensile Strength (Kg/mm²) | Conductivity |
|---|---|---|---|---|
| | Cu + Be + Co + Ni + Fe | 99.5% or more | | |
| Copper Alloy* No. 175 | Be | 0.4–0.7% | 80–100 | 48% |
| | Co + Ni | 2.37–2.7% | | |
| | Co + Ni + Fe | 0 | | |
| | Cu + Be + Co + Ni + Fe | 99.5% or more | | |

*A trade name of Copper Development Association Inc.

TABLE IV

| U.S. ASTEM Standard | Composition | | Tensile Strength (Kg/mm²) | Conductivity (IACS) |
|---|---|---|---|---|
| C5101-H | Sn | 5% | 53–64 | 15% |
| | P | 0.2% | | |
| | Fe | 0 | | |
| | Cu | 94.8% | | |
| Copper Alloy* No. 502 | Sn | 1% | 50 or more | 50% |
| | P | 0.03% | | |
| | Fe | 0.1% | | |
| | Cu | 98.87% | | |

*A trade name of Copper Development Association Inc.

Figure 9:
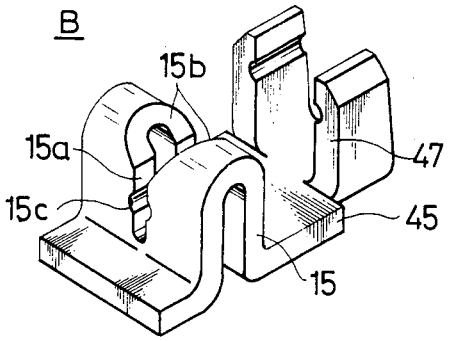
FIG. 9 is a perspective view of another embodiment of the wire connecting portion of the slotted terminal of the present invention.

Referring to FIG. 9 illustrating another embodiment of the wire connecting portion of the present invention, the wire connecting portion B comprises a joint section 45, a first wire connecting section 15 of inverted U-shape formed by folding the front extension of the joint section 45, and a second wire connecting section 47 of U-shape on the rear extension of the joint section 45. The first wire connecting section 15 is formed with a slotted opening 15*a* and tapered edges 15*b* above the slotted opening 15*a*. The slotted opening 15*a* is provided with arcuate recesses 15*c* on the opposite edges thereof.

Figure 10:
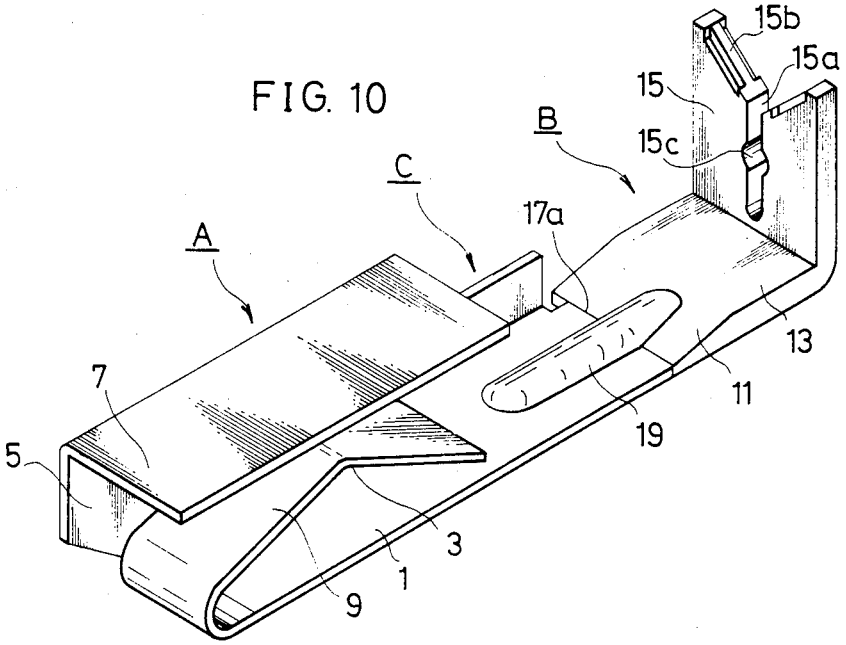
FIG. 10 is a perspective view of another embodiment of the slotted terminal of the present invention.

FIG. 10 illustrates another embodiment of the slotted terminal C of the present invention, which comprises a terminal contact portion A and a wire connecting portion B in a similar manner as shown in FIG. 5. However, in this embodiment, the terminal contact portion A and the wire connecting portion B are separately formed, and then bonded along the bonding line 17*a* by means of e.g. laser welding. Since the other components are the same as those illustrated in FIG. 5, the description thereof is omitted.

As mentioned above, according to the present invention, a compact wire-harness is achieved, wherein wires of a smaller diameter are used without decreasing electric current capacity and the strength of wires are increased with necessary flexibility being kept.

In addition, in the present invention, the S.B. conductor used will not deform upon connecting to the slotted terminal, whereby stable connection desirable for the automatic assembly of the wire-harness is secured.

Further, a relatively thick plate is used to form the wire connecting portion for receiving the S.B. conductor inserted therein, which provides stability in connection joint between the terminal and the wire, and flexibility required for connection between the terminal and the mating terminal.

While preferred embodiments of this invention have been shown and described, it will be appreciated that other embodiments will become apparent to those skilled in the art upon reading this disclosure, and, therefore, the invention is not to be limited by the disclosed embodiments.

What is claimed is:

1. A wire harness of the slotted terminal type, comprising:

a first terminal contact portion including a base, a resilient contact tang integral with the base and bent over the base, and a side extension integral with the base and folded upward to form a side wall substantially perpendicular to the base and a top wall substantially parallel to the base, wherein the top wall is arranged to define a clearance for receiving a terminal and disposed between the top wall and the resilient contact tang;

a second wire connecting portion, connected to the terminal contact portion, having a thickness greater than the thickness of the terminal contact portion, and including a sloped transition adjacent to the terminal contact portion, and a distal end for defining a wire connecting section, wherein the distal end is bent upwards and includes a slotted opening having tapered edges for guiding a wire, and having arcuate recesses for receiving the wire under pressure, a reinforcing member for increasing the strength of the transition section and a connection between the first and second portions.

2. A wire harness as recited in claim 1, wherein said first and second portions are produced from a single piece of the same material.

3. A wire harness as recited in claim 1, wherein said first and second portions comprise first and second pieces of different materials, wherein the first and second pieces are bonded together.

4. A wire harness as recited in claim 1, wherein said first portion comprises beryllium bronze or phosphor bronze, and wherein said second portion comprises a copper alloy.

5. A wire harness as recited in claim 1, wherein said first portion comprises a first material having a high spring capacity, and wherein said second portion comprises a second material having a high electrical conductivity.

6. A wire harness as recited in claim 1, wherein said wire comprises twisted and compressed wire having a compressability in the range between about 7% and about 15%.

7. A wire harness as recited in claim 1, wherein said first portion comprises a first material having a high spring capacity, and wherein said second portion comprises a second material having a high strength.

8. A wire harness as recited in claim 7, wherein said first material comprises a first type of brass and said second material comprises a second type of brass.

9. A wire harness of the slotted terminal type, comprising:

a first terminal contact unit including a first terminal contact section and a second mount section, wherein the first section includes means for receiving and securing a mating terminal, wherein the second section includes two second side wall sections, and two third side walls disposed away from the first terminal contact section;

a second wire connecting unit including a first upright wire connecting section having a first slotted opening and tapered edges for guiding a wire into the first slotted opening, a second upright wire connecting section having a second slotted opening and tapered edges for guiding a wire into the second slotted opening, and a joint section disposed between the first and second connection sections and connected to the first contact unit by crimping said second side wall sections.

10. A wire harness as recited in claim 9, wherein said means for receiving and securing a mating terminal comprises:

first and second integral side extensions bent to define an opening for receiving a mating terminal and having two first side walls and a top wall;

leaf spring means having first and second ends, for securing the mating terminal and disposed in said opening;

cut-out means disposed in said side extensions, and for supporting the first end of the leaf spring means; and tab means for supporting the second end of the leaf spring means.

11. A wire harness as recited in claim 9, wherein said cut-out means comprises a slot through the first side walls and the top wall.

12. A wire harness as recited in claim 9, wherein the wire comprises twisted and compressed wire.

* * * * *